United States Patent [19]

Zysset

[11] Patent Number: 5,052,573

[45] Date of Patent: Oct. 1, 1991

[54] EASY OPEN END FOR CONTAINERS EMPLOYING ENLARGED MOUSTACHE SCORE

[75] Inventor: Edgar H. Zysset, St. Cloud, Fla.

[73] Assignee: Automated Container Corporation, Plymouth, Fla.

[21] Appl. No.: 482,518

[22] Filed: Feb. 21, 1990

[51] Int. Cl.[5] ..... B65D 17/34

[52] U.S. Cl. ..... 220/271; 220/276

[58] Field of Search ..... 220/270, 271, 272, 273, 220/276

[56] References Cited

U.S. PATENT DOCUMENTS 3,544,025 12/1970 La Croce ..... 220/273

3,606,076 9/1971 Hanke et al. ..... 220/273

4,002,262 1/1977 Khoury ..... 220/271

4,406,378 9/1983 Zysset ..... 220/273

*Primary Examiner*—Stephen Marcus

*Assistant Examiner*—Nova Stucker

*Attorney, Agent, or Firm*—Duckworth, Allen, Dyer & Doppelt

[57] ABSTRACT

An easy open end employs an enlarged "moustache" score, in which the apex of the outward curves of the score lie outside of the plane of the sides of the pull tab to effectuate a rolling of the metal ribbon between the rivet and the peripheral weakened area, so as to avoid lateral forces which tend to tear the metal along the ribbon.

4 Claims, 2 Drawing Sheets

EASY OPEN END FOR CONTAINERS EMPLOYING ENLARGED MOUSTACHE SCORE

BACKGROUND OF THE INVENTION

1. Field of the Invention

The present invention relates generally to easy open ends for containers, and in particular relates to easy open metal ends which employ a "moustache" vent score.

The term "easy open end" is used generally for that class of ends for containers which are provided with a mechanism for permitting the consumer to open the container at the end for access to the ingredients within the container, without the use of a can opener or other machinery. One conventional easy open end technique employs a pull tab having a pointed nose, the pull tab being riveted to the panel of the end so that the nose rests adjacent a weakened area along the periphery of the end panel. To open, the pull tab is rotated about the rivet, causing the nose to fracture the weakened area. Further pulling of the tab away from the end panel then causes the remainder of the weakened peripheral to rupture, thereby permitting the entire end to be opened.

It is also known in the prior art to employ a vent score behind the rivet toward the center of the panel to relieve internal pressure within the container, and thereby avoid implosion or explosion as the container is opened by rotation of the pull tab about the rivet. The most frequently used shape for the vent score is curved much like a man's moustache, and is therefore conventionally referred to as the "moustache score". FIGS. 1 and 2 illustrate prior art moustache score techniques, as is described further below.

Noting FIG. 1, a prior art end panel employing a moustache score is referred to generally by the reference numeral 10. Typically, the end panel is formed of tin-plated stainless steel, and includes a peripheral bead 14 which is conventionally attached to the end of either a metal or composite container. The end panel further includes a peripheral weakened area 16, which may be formed by crimping, scoring or other means. The central area of the end is an essentially flat metal area. A pull tab 18 (which is shown in dotted lines to illustrate the appearance of the moustache score 28, described in greater detail below) is joined to the central area 12 via a rivet 20. The pull tab 18 includes lateral and opposing sides 24, 26 which extend forwardly to a pointed nose 22, and which rests adjacent and over the weakened area 16. The moustache score 28 includes a pair of outward curves 30 and an inward curve 29, the inward curve essentially curving about the rivet in the direction of the center of the panel 12. Conventionally, the apex of the outer curves 30 lie within the area bounded by the sides 24, 26 of the pull tab 18.

It is also conventional to employ a peripheral reinforcing bead 32 spaced inwardly from the weakened area 16, and a pair of lateral reinforcing beads 34, 36 which extend across the central area 12 of the end panel 10. As thus configured, the prior art end panel 10 defines an area 15 generally between the rivet and the weakened area 16, and a thin portion between the rivet 20 and the inward curvature 29 of the moustache score 28.

A major disadvantage of an end panel like that described above with reference to FIG. 1 will now be described with reference to FIG. 2. As is shown in FIG. 2, the pull tab is used to open the container by pulling upwardly about the rivet 20, causing the nose 22 to rupture the weakened area 16. It is frequently necessary to rotate the pull tab virtually 180 degrees from its initial position in order to obtain complete rupture. When this occurs, the central area 12 of the end panel 10 is curved downwardly as is shown along portions 11 adjacent the pull tab. It has been observed that frequently the metal area 15 which lies between the rivet 20 and the weakened area 16 tears along line's 38 and 40, thereby creating a dangerous cutting edge which may injure the consumer.

SUMMARY OF THE INVENTION

The present invention is directed to the discovery that an improved moustache score configuration will avoid the tearing described above and illustrated in FIG. 2. Generally, it has been discovered that a revised moustache score utilizing a configuration in which the apex of the outer curves lie outside of the lateral sides of the pull ring drastically reduces the likelihood of tearing of the metal ribbon portion between the rivet and the weakened area. Dynamically, this is achieved by insuring that the position and dimension of a relief partial score (which in the preferred embodiment also takes the configuration of a moustache) are selected to prevent tearing of the metal in the ribbon except along the line of the relief partial score and the weakened peripheral area, when the pull tab is rotated through a substantial angle in order to drive the nose through the weakened area. This effectuates a rolling of the metal ribbon between the rivet and the weakened area upwardly with respect to the plane of the end panel and outwardly with respect to the central area with lateral tearing of the ribbon only along the relief partial score and the weakened area, without creating significant lateral forces through the metal which would tend to tear the metal contained along that ribbon material.

It has also been determined that these objectives may be facilitated by drawing back the ends of the peripheral and lateral reinforcing beads a substantial dimension from the ends of the partial relief score. Suitably, this dimension is on the order of 0.7 centimeters on a 7.3 centimeter end.

DESCRIPTION OF THE DRAWINGS

As discussed above, in FIG. 1, the pull tab is illustrated in the position before opening, and in FIG. 2 the pull tab is shown rotated through approximately 180 degrees for purposes of opening the end.

FIG. 3 illustrates the pull tab before opening and FIG. 4 illustrating the pull tab when rotated through approximately 180 degrees to achieve the opening of the end. In FIGS. 3 and 4, common reference numerals are used to identify the same features shown in FIGS. 1 and 2.

DETAILED DESCRIPTION

Figure 1:
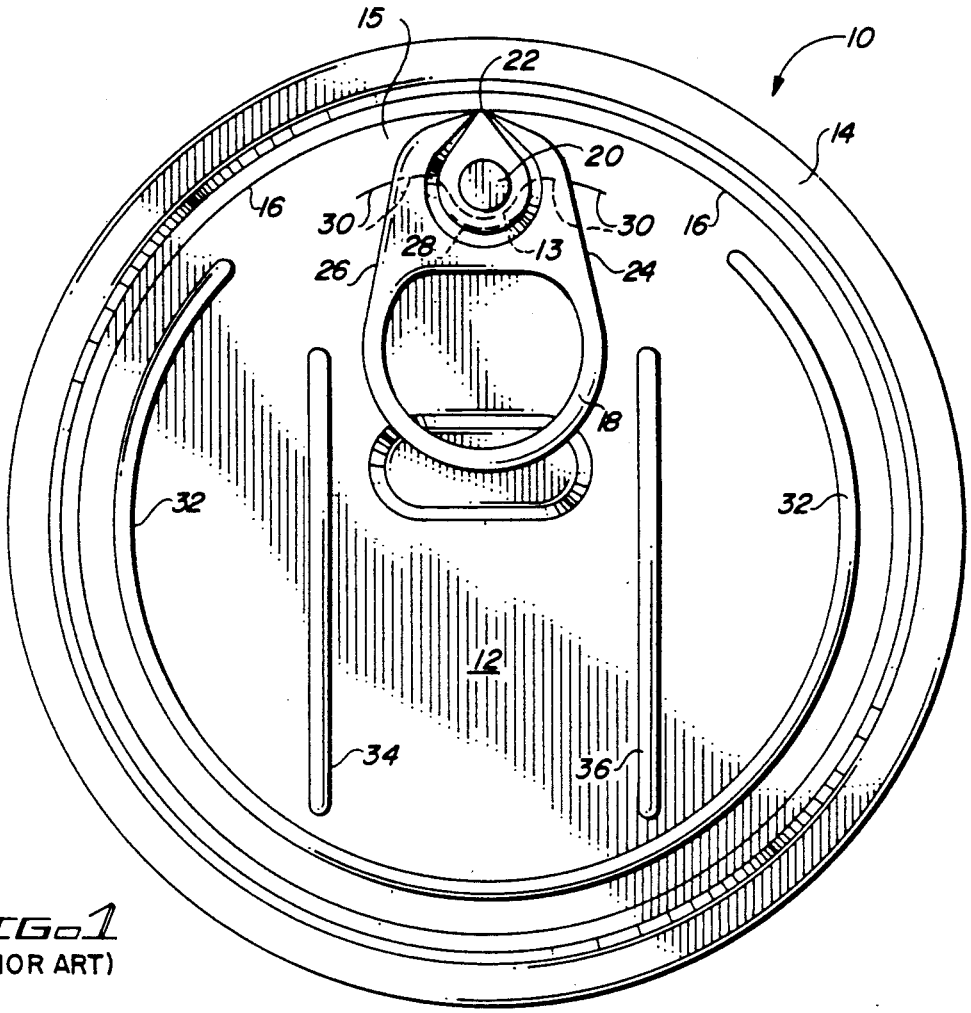
FIG. 1 (PRIOR ART)
FIGS. 1 and 2 illustrate top plan views of prior art end panels utilizing a conventional moustache partial vent score.
Figure 2:
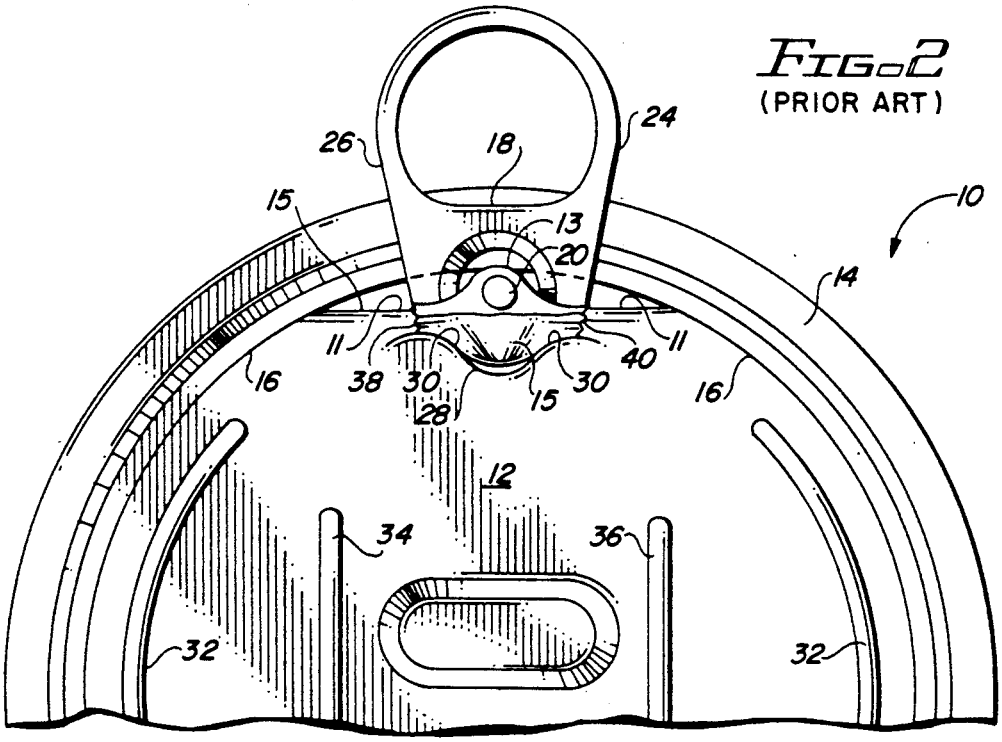
FIG. 2 (PRIOR ART)
Figure 3:
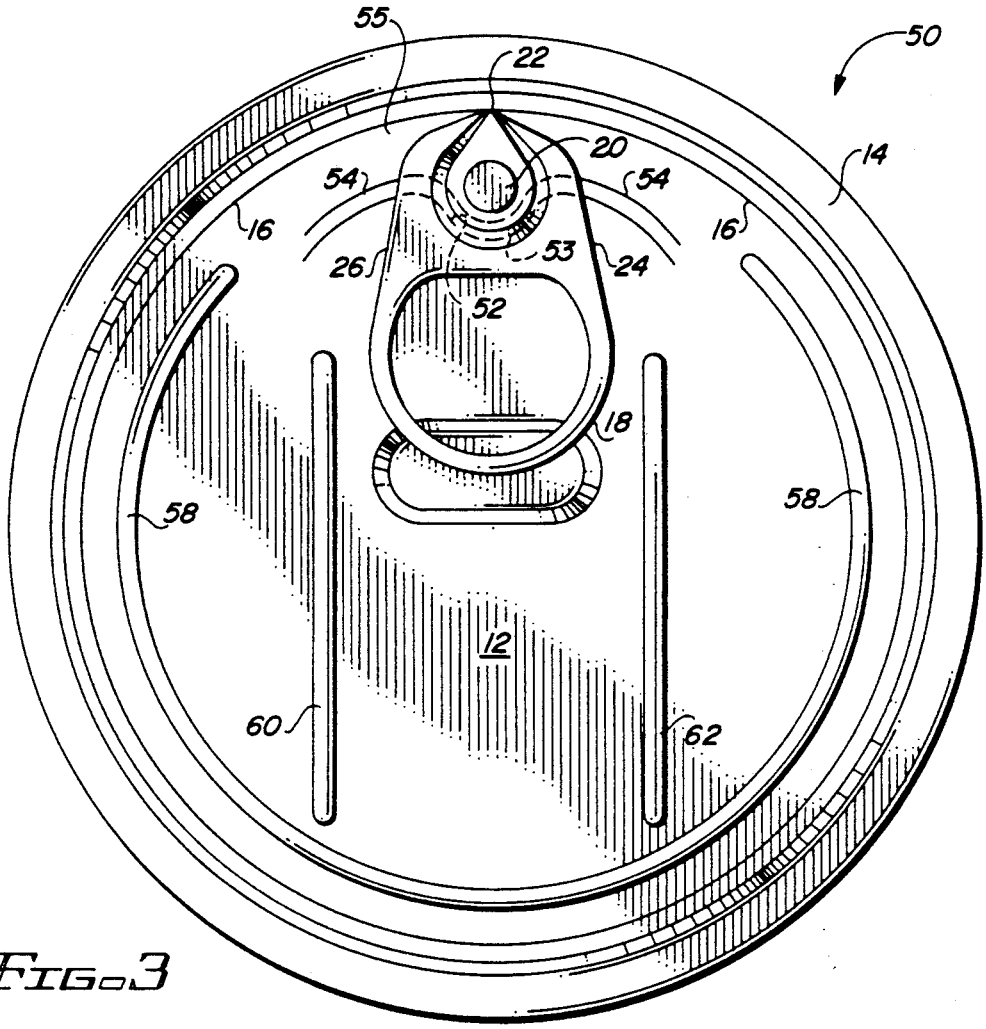
FIGS. 3 and 4 illustrate the present invention, and constitute partial top plan views of an easy open end utilizing the present invention.
Figure 4:
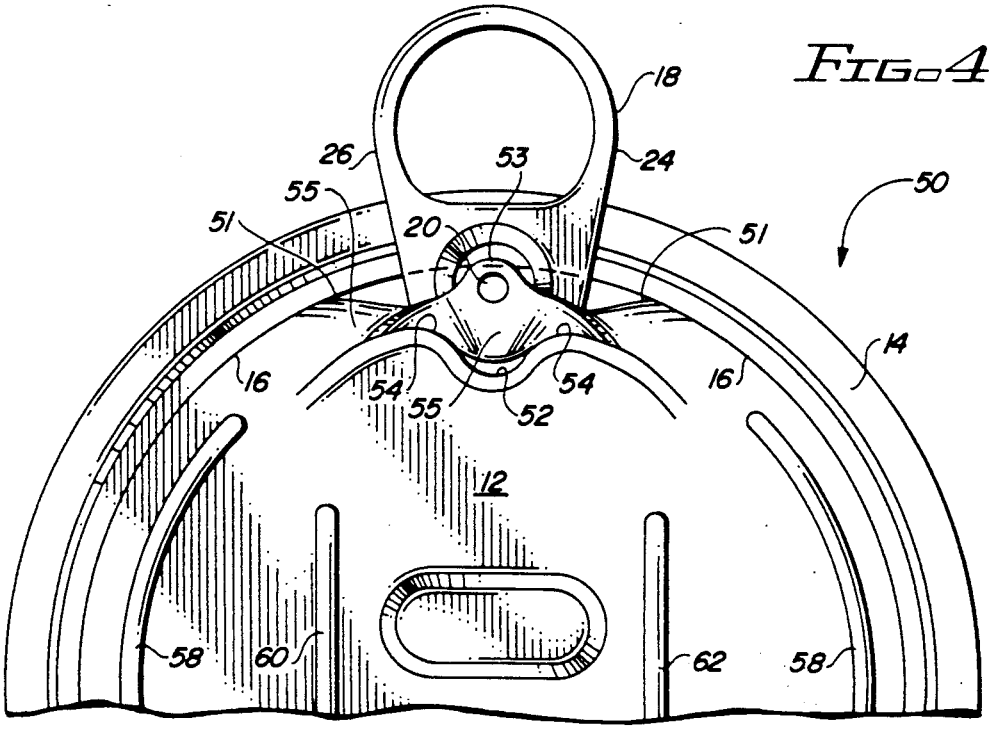

An end panel in accordance with the present invention is referred to generally by the reference numeral 50 in FIGS. 3 and 4. Noting FIG. 3, the end panel 50 includes a modified moustache score 52 having an inward curve 51 much like the inward curve 29 of the score 28 in FIG. However, the modified score 52 in FIG. 3 employs a pair of outward curves 54, the apex of which are substantially spread apart with respect to the apex of the curves 30 in FIG. 1, with the apex of the curves 54 lying outside of the plane of the lateral sides 24, 26 of the pull tab 18. Further, the peripheral reinforcing bead 58 and the lateral reinforcing beads 60, 62 shown in FIGS. 3 and 4 are drawn back at their respective ends from the end of the moustache score 52 a substantial distance, typically on the order of 0.7 centimeters for a 300 end. As so defined, the moustache score 52, the rivet 20 and the weakened area 16 define a ribbon 55 of end panel material which lies generally between the rivet 20 and the weakened area 16 and a thin metal portion 53 between the rivet 20 and the inward curve 51 of the moustache score 52.

Referring now to FIG. 4, the pull tab 18 is shown rotated generally 180 degrees in order to open the end panel 50. Because of the greater curvature of the moustache score 52, the lateral force of the motion of the pull tab 18 is significantly reduced, thereby substantially reducing the risk of tearing of the ribbon 55, which is curled along the line 51 without tearing. It will thus be appreciated by those skilled in the art that the position and dimension of the relief partial score 52 is selected to prevent tearing of the metal in the ribbon 15, except along the line of the score 52 (including the outer curves 54) and the weakened area 16 when the pull tab 18 is rotated through a substantial angle; instead, the position and dimension of the relief partial score effectuates a rolling of the metal ribbon 55 out of the plane of the central area so that the lateral tearing of the ribbon 55 is only along the partial score 52 and the weakened area 16, as the pull tab nose 22 is driven through the weakened area 16. It will also be appreciated that the withdrawing of the ends of the peripheral and lateral reinforcing beads 58, 60 and 62 facilitates that objective.

What is claimed is:

1. An easy open end for a container, comprising:

a metal end panel having a weakened area along at least a portion of its periphery;

a pull tab extending generally radially across the end panel and having a pull ring disposed inwardly across the panel and a nose adjacent a point along the weakened area, the pull tab having peripheral sides between the pull ring and the nose;

means fastening the pull tab to the end panel at a point on the pull tab between the pull ring and the nose, and to the end panel at a point spaced radially inwardly from the weakened area;

a "moustache" score in the end panel inwardly of the fastening means, the "moustache" score defined by a central curve extending radially inwardly and an outwardly extending curve on either side of the inwardly extending curve, with the apex of each outwardly extending curve of the "moustache" score lies outside of the adjacent side of the pull tab; and at least one lateral reinforcing bead extending across a portion of the metal end panel, the lateral reinforcing bead having an extremity in the direction of the "moustache" score which is drawn back a substantial dimension from that score so as to avoid interference with the rolling of metal about the "moustache" score during opening.

2. An easy open end for a container, comprising:

a metal end panel having a weakened area along at least a portion of its periphery;

a pull tab extending generally radially across the end panel and a nose adjacent a point along the weakened area, the pull tab having peripheral sides between the pull ring and the nose;

means fastening the pull tab to the end panel at a point on the pull tab between the pull ring and the nose, and to the end panel at a point spaced radially inwardly from the weakened area;

a "moustache" score in the end panel inwardly of the fastening means, the "moustache" score defined by a central curve extending radially inwardly and an outwardly extending curve on either side of the inwardly extending curve, with the apex of each outwardly extending curve of the "moustache" score lies outside of the adjacent side of the pull tab; and a peripheral reinforcing bead extending about a portion of the periphery of the end panel, the peripheral reinforcing bead having opposing extremities in the direction of the "moustache" score, which extremities are drawn back of substantial dimension from the "moustache" score so as to avoid interference with the rolling metal about the "moustache" score during opening.

3. An easy open end for a container, comprising:

a metal end panel having a central area and a weakened area extending about its periphery;

a pull tab having a nose at one end and a pull ring at the other end;

a rivet joining the pull tab to the metal end panel so that the nose is positioned over the peripheral weakened area and the pull extends radially inwardly along the end panel toward the central area;

a relief partial score in the end panel between the rivet and the central area, the relief partial score and the periphery weakened area defining a ribbon of end panel metal, with the position and dimension of the relief partial score selected to prevent tearing of the metal in the ribbon except along the line;

the position and dimension of the relief partial score are selected to prevent tearing of the metal in the ribbon except along the line of the relief partial score and the weakened area when the pull tab is rotated through a substantial angle in order to drive the nose through the weakened are for purposes of opening the container; and at least one lateral reinforcing bead extending across a portion of the metal end panel, the lateral reinforcing bead having an extremity in the direction of the "moustache" score which is drawn back a substantial dimension from that score so as to avoid interference with the rolling of metal about the "moustache" score during opening.

4. An easy open container for a container, comprising:

a metal end panel having a central area and a weakened area extending about its periphery;

a pull tab having a nose at one end and a pull ring at the other end;

a rivet joining the pull tab to the metal end panel so that the nose is positioned over the peripheral weakened area and the pull tab extends radially inwardly along the end panel toward the central area;

a relief partial score in the end panel between the rivet and the central area, the relief partial score and the periphery weakened area defining a ribbon of end panel metal, with the position and dimension of the relief partial score selected to prevent tearing of the metal in the ribbon except along the line;

the position and dimension of the relief partial score are selected to prevent tearing of the metal in the ribbon except along the line of the relief partial score and the weakened area when the pull tab is rotated through a substantial angle in order to drive the nose through the weakened area for purposes of opening the container; and a peripheral reinforcing bead extending about a portion of the periphery of the end panel, the peripheral reinforcing bead having opposing extremities in the direction of the "moustache" score, which extremities are drawn back a substantial dimension from the "moustache" score so as to avoid interference with the rolling metal about the "moustache" score during opening.

* * * * *